US007568831B2

(12) United States Patent
Greubel et al.

(10) Patent No.: US 7,568,831 B2
(45) Date of Patent: Aug. 4, 2009

(54) TOURBILLION-TYPE TIMEPIECE MOVEMENT

(75) Inventors: Robert Alain Greubel, Suisse (CH); Stephen Edward Methuen Forsey, Suisse (CH)

(73) Assignee: Tiffany & Co. Watch Center AG, Zurich (CH)

( * ) Notice: Subject to any disclaimer, the term of this patent is extended or adjusted under 35 U.S.C. 154(b) by 0 days.

(21) Appl. No.: 11/544,466

(22) Filed: Oct. 6, 2006

(65) Prior Publication Data

US 2008/0084793 A1 Apr. 10, 2008

(51) Int. Cl.
*G04B 15/00* (2006.01)
*G04B 17/28* (2006.01)

(52) U.S. Cl. ..... 368/127; 368/142; 368/280

(58) Field of Classification Search ..... 368/124–138, 368/280, 309, 169, 142
See application file for complete search history.

(56) References Cited

U.S. PATENT DOCUMENTS

| | | | | |
|---|---|---|---|---|
| D14,919 | S | 3/1884 | Perreaux | |
| 2,060,531 | A | 10/1936 | Rodanet | |
| 2,153,004 | A | 4/1939 | Rodanet | |
| RE22,640 | E | 5/1945 | Prins | |
| 2,466,312 | A | 4/1949 | Heint | |
| 2,506,134 | A | 5/1950 | Burchell | |
| 2,639,577 | A | 5/1953 | Lubin | |
| 2,643,506 | A | 6/1953 | Rodanet | |
| 2,852,908 | A | 9/1958 | Stern | |
| 2,886,942 | A | 5/1959 | Stucky | |
| 3,668,858 | A | 6/1972 | Hartwig | |
| 4,362,397 | A | 12/1982 | Klingenberg | |
| 4,382,690 | A | 5/1983 | Erard | |
| 4,407,586 | A * | 10/1983 | Musy | 368/77 |
| 4,459,032 | A * | 7/1984 | Musy | 368/77 |
| 4,461,580 | A | 7/1984 | Erard | |
| 4,534,660 | A * | 8/1985 | Laesser | 368/220 |
| D336,865 | S | 6/1993 | Besson | |

(Continued)

FOREIGN PATENT DOCUMENTS

| | | |
|---|---|---|
| CH | 198192 | 9/1938 |

(Continued)

OTHER PUBLICATIONS

"Tourbillon: torque", Russian Cigar Clan Magazine, www.cigarclan.com/articles.

(Continued)

*Primary Examiner*—Vit W Miska
*Assistant Examiner*—Sean Kayes
(74) *Attorney, Agent, or Firm*—Lucas & Mercanti, LLP; Peter J. Phillips

(57) ABSTRACT

A timepiece movement movement comprises a casing having a mechanical energy source, a work train driven by the energy source, a fixed wheel mounted on the casing, and a tourbillion comprising a cage which bears a balance wheel, an escape mobile provided with a pinion engaging with the fixed wheel, and a cage wheel rotationally joined to the cage and provided on its periphery with a toothing engaging with the work train. The casing of this movement is constituted, in its part occupied by the tourbillion, by a transparent material. In addition, the cage wheel comprises a transparent-material platelet, which extends radially beyond the other constituents of the tourbillion.

7 Claims, 2 Drawing Sheets

U.S. PATENT DOCUMENTS

| | | | | |
|---|---|---|---|---|
| 5,608,694 | A * | 3/1997 | Grimm et al. | 368/127 |
| 5,838,641 | A * | 11/1998 | Tohkoku et al. | 368/127 |
| 6,367,965 | B1 | 4/2002 | Kiu | |
| 6,402,368 | B1 * | 6/2002 | Grimm et al. | 368/127 |
| D475,647 | S | 6/2003 | Grotell | |
| 6,749,333 | B2 | 6/2004 | Scheufele | |
| 6,846,104 | B2 | 1/2005 | Geyer | |
| 6,877,893 | B2 | 4/2005 | Mock | |
| 6,890,094 | B2 * | 5/2005 | Dias | 368/127 |
| 7,008,102 | B2 * | 3/2006 | Taillard et al. | 368/127 |
| 7,316,504 | B1 * | 1/2008 | Mock et al. | 368/127 |
| 2003/0112709 | A1 | 6/2003 | Majon | |
| 2004/0062149 | A1 | 4/2004 | Geyer | |
| 2004/0184356 | A1 | 9/2004 | Dias | |
| 2005/0122844 | A1 | 6/2005 | Ruchonet | |
| 2005/0201209 | A1 | 9/2005 | Golay | |

FOREIGN PATENT DOCUMENTS

| | | | |
|---|---|---|---|
| CH | 290358 | | 4/1953 |
| CH | 639 812 | | 12/1983 |
| CH | 668 156 | | 12/1988 |
| CH | 151 | | 1/1989 |
| CH | 673372 | | 3/1990 |
| CH | 676 187 | | 12/1990 |
| CH | 677056 | | 4/1991 |
| CH | 681 415 | | 3/1993 |
| CH | 682 117 | | 7/1993 |
| CH | 685 224 | | 5/1995 |
| CH | 685 363 | | 6/1995 |
| CH | 686 208 | | 2/1996 |
| CH | 686 542 | | 4/1996 |
| CH | 690 522 | | 9/2000 |
| CH | 692 462 | | 6/2002 |
| CH | 693 833 | | 2/2004 |
| CH | 694 598 | | 4/2005 |
| CH | 694 833 | | 7/2005 |
| DE | G 84 35 368.6 | | 4/1985 |
| DE | G 89 08664.3 | | 11/1989 |
| DE | 3940254 | A1 | 6/1991 |
| DE | 422 6926 | | 9/1993 |
| DE | 29813336 | U1 | 12/1998 |
| EP | 0 131 267 | A1 | 1/1985 |
| EP | 0 360 140 | A1 | 3/1990 |
| EP | 0 545 229 | A1 | 6/1993 |
| EP | 0 673 519 | A1 | 4/1995 |
| EP | 0 520 218 | B1 | 8/1995 |
| EP | 0 668 551 | A1 | 8/1995 |
| EP | 0 681 227 | A1 | 11/1995 |
| EP | 0 727 721 | A1 | 8/1996 |
| EP | 0 507 097 | B1 | 11/1996 |
| EP | 0 791 191 | A1 | 3/1997 |
| EP | 1 055 157 | A1 | 7/1999 |
| EP | 1 243 985 | A1 | 9/2002 |
| EP | 1 419 419 | A1 | 2/2003 |
| EP | 1 349 019 | | 10/2003 |
| EP | 1 564 608 | A2 | 8/2005 |
| EP | 1 481 293 | A1 | 9/2006 |
| ES | 2 164 024 | | 2/2002 |
| FR | 2578 335 | | 9/1986 |
| FR | 2590 998 | | 5/1987 |
| FR | 2628 855 | | 9/1989 |
| FR | 2632 426 | | 12/1989 |
| GB | 436531 | | 10/1935 |
| GB | 2 050 654 | A | 1/1981 |
| GB | 2 176 032 | A | 12/1986 |
| GB | 2 351 163 | A | 12/2000 |
| JP | 52028358 | | 3/1977 |
| JP | 59065787 | | 2/1984 |
| WO | WO 03/017009 | A2 | 2/2003 |
| WO | WO 03/048871 | A3 | 6/2003 |
| WO | WO 2004/006025 | A2 | 1/2004 |
| WO | WO 2005/054961 | | 6/2005 |

OTHER PUBLICATIONS

PTS Resources Ltd., # 3612, www.stylewatch.com.
"Gerard-Perregaux: Tourbillon Under Three Gold Bridges, Automatic", by PeterCDE, www.p178host.com/gpgallery.

* cited by examiner

TOURBILLION-TYPE TIMEPIECE MOVEMENT

BACKGROUND OF THE INVENTION

The present invention relates to timepiece, i.e., clock and watch movements provided with a tourbillion, and more particularly to mysterious-type tourbillons, as will be described. The term "tourbillion" should here be taken in the broad sense, also covering systems referred to as carrousels. These movements traditionally comprise a casing and, mounted on the same, an energy source, a winding and time-setting mechanism responsible for loading the energy source, and a work train connected to the energy source and driving the tourbillion.

The tourbillion, developed by Breguet more than two centuries ago, comprises a rotatable cage, provided with a cage toothing meshing with the work train which turns it, and a time base comprising an escapement and a balance wheel, the escapement comprising a mobile, provided with a pinion engaging with a fixed wheel mounted on the casing, and with a wheel which is responsible for driving the balance wheel via a pallet fork, for example.

The tourbillion was developed to reduce the sensitivity of the watch to vertical positions. This result is obtained by turning the balance wheel with the cage over a cycle of the order of a minute. For more details in this regard, the work entitled "Theorie d'horlogerie", ISBN 2-940025-10-X, pages 167 and 168, may be consulted.

Such a device entails high-level technical expertise, such that it is readily integrated in high-price movements designed to equip top-of-the-range watches.

Moreover, so-called mysterious watches and carriage clocks are known, in which the observer has the impression that a part of the movement or of the display means are, as it were, suspended in a transparent space, unconnected to other work or drive means in the watch or clock. A watch of this type is described in the book entitled "le grand livre des montres" ISBN 2-263-01722-4, page 70. In this watch, the hands are disposed between two glass plates, and the drive means are not visible. These means are generally constituted by transparent discs.

SUMMARY OF THE INVENTION

The object of the present invention is to provide a clock or watch movement provided with a tourbillion, the latter appearing in a space in which no part is visible. More precisely, this movement comprises a casing which bears a mechanical energy source, a work train driven by the energy source, a fixed wheel mounted on the casing, and a tourbillion which comprises a cage bearing a balance wheel, an escape mobile provided with a pinion engaging with the fixed wheel, and a cage wheel rotationally joined to the cage and provided on its periphery with a toothing engaging with the work train.

According to the invention, the casing is constituted, in its part occupied by the tourbillion, by a transparent material, and the cage wheel comprises a transparent-material platelet, which extends radially beyond the other constituents of the tourbillion. The platelet is provided on its periphery with a toothing, engaging with a mobile of the work train.

Owing to this particular configuration, it is possible to realize a tourbillion-type watch movement comprising, on the circumference of the tourbillion, a tubular space in which there is no opaque part present, and thus to obtain the longed-for mysterious effect.

In this way, the tourbillion is perfectly visible without the need to adopt a floating solution, that is to say mounted pivotably by only one of its ends.

Thus, the cage advantageously comprises two pivots, each disposed at one of the ends of the central part, and the casing comprises two transparent plates, each being responsible for the pivoting function for one of the pivots of the cage.

In order to confer the best possible aesthetic quality, the transparent material is preferably sapphire, but could be made of any transparent material.

In a first embodiment, the toothing belonging to the platelet of the cage wheel is cut directly in the material of which it consists. In another embodiment, the platelet bears on its periphery a metal ring in which the toothing is cut.

DESCRIPTION OF THE DRAWINGS

Other advantages and characteristics of the invention will emerge from the following description, rendered with reference to the appended drawing, in which.

DESCRIPTION OF A PREFERRED EMBODIMENT

Figure 1:
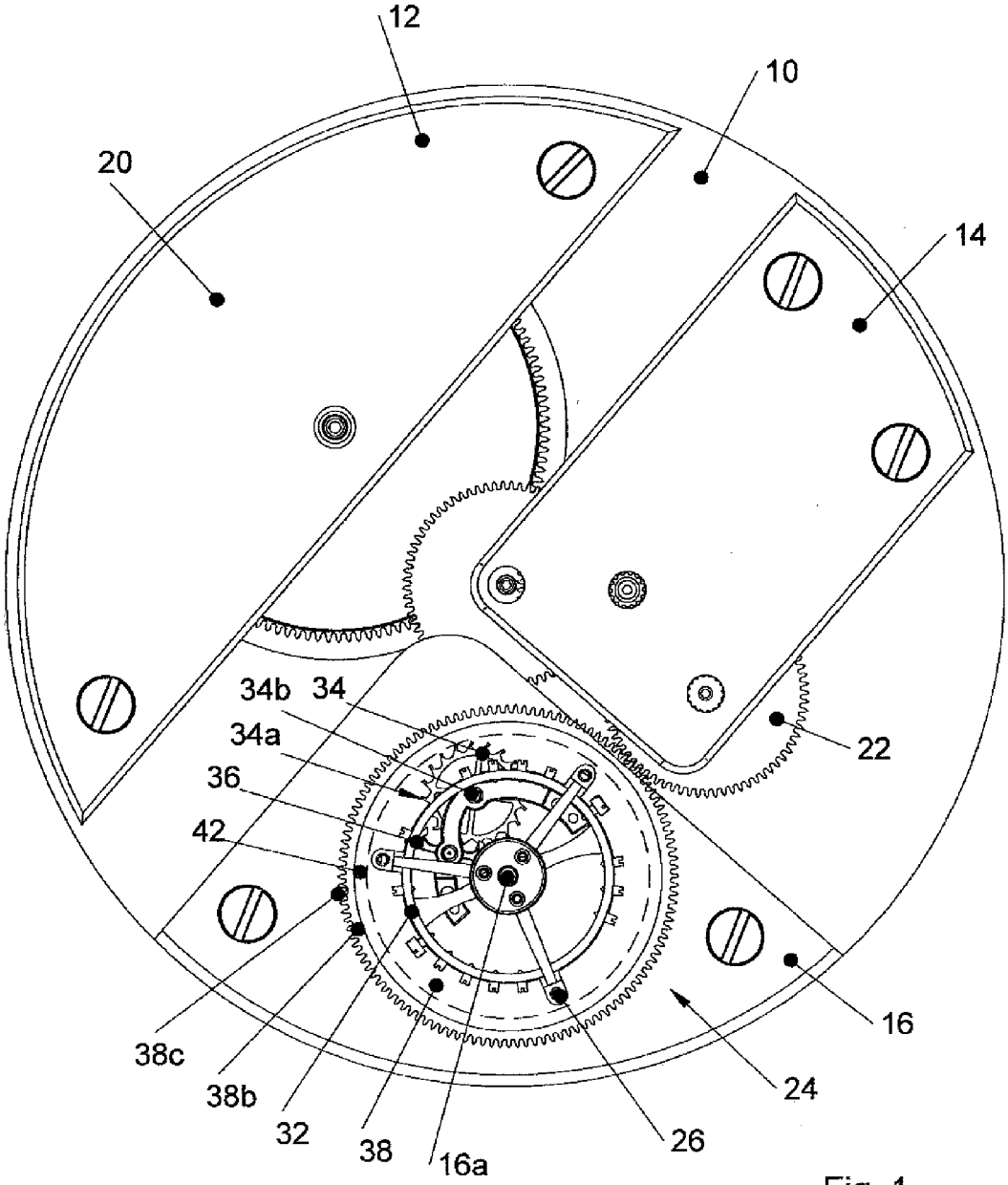
FIGS. 1 and 2 show in section and in top view, respectively, a part of a movement according to the invention.
Figure 2:
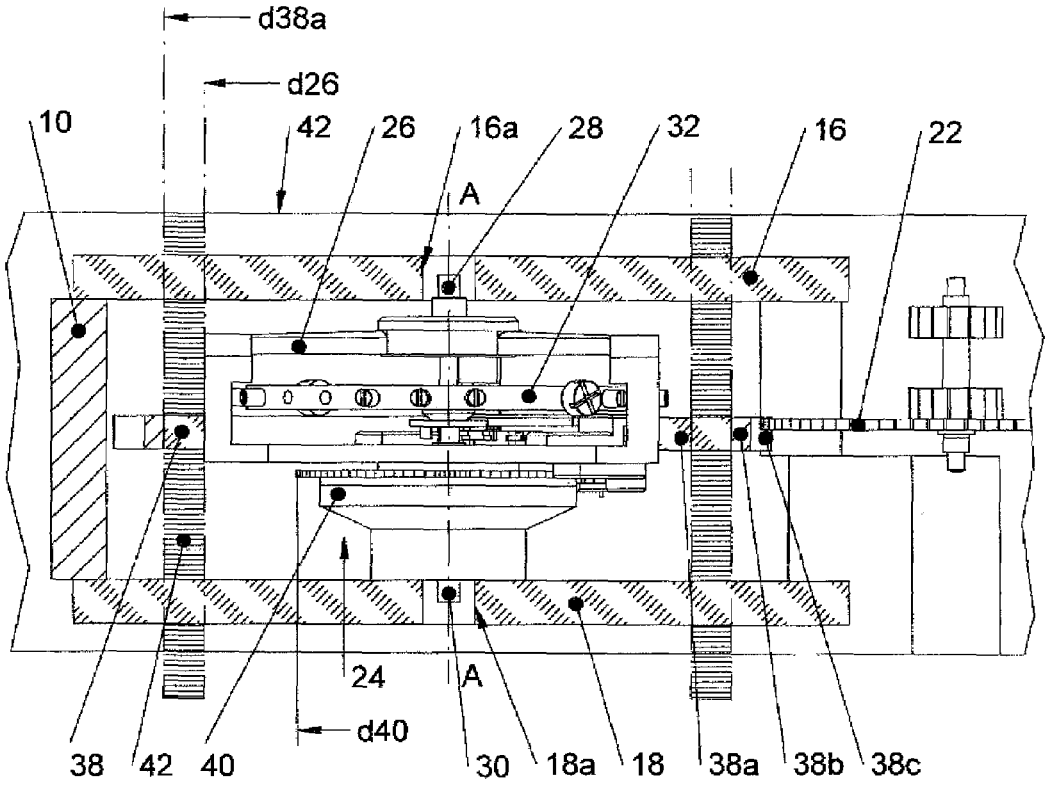

A preferred embodiment will be described as one example of a way to practice the invention, but its scope is not limited to this embodiment.

The movement represented in the drawing comprises a casing composed of a bottom plate 10, barrel bridges 12 and train bridges 14, as well as two tourbillion plates 16 and 18. The bottom plate 10 and the bridges 12 and 14 are made of brass or gold, whereas the plates 16 and 18 are made of sapphire or any other transparent material.

A barrel 20 is rotatably mounted on the casing. It is loaded by means (not shown) which are well known to the person skilled in the art and which are described, in particular, in the aforementioned work entitled "Théorie d'horlogerie".

The barrel drives a work train, the last mobile 22 of which performs one revolution a minute. This mobile 22 can bear a seconds hand.

A tourbillion 24 is pivotably mounted between the plates 16 and 18. It comprises a cage 26, two pivots 28 and 30 disposed on either side of the cage and engaged in bearings 16*a* and 18*a* belonging to the plates 16 and 18, defining a pivot axis AA of the cage 26.

A balance wheel 32, an escape mobile 34 comprising a wheel 34*a* and a pinion 34*b*, and a pallet fork 36 are pivotably mounted on the cage 26.

The cage 26 is provided with a cage wheel 38 composed of a transparent annular platelet 38*a*, the circumference of which bears a metal ring 38*b* provided, on its periphery, with a toothing 38*c* meshing with the mobile 22. As a variant, the toothing 38*c* could also be cut directly in the platelet 38*a*.

The plate 18 bears a fixed wheel 40 arranged such that it meshes with the pinion 34*b*.

The diameter d26 of the cage 26 and the diameter d40 of the fixed wheel 40 are markedly less than the external diameter d38*a* of the platelet 38*a*. Since, moreover, the plates 16 and 18 are made of transparent material; an annular portion 42 exists around the cage 26, in which no opaque or visible part is found. Moreover, the plates 16 and 18, as well as the platelet 38*a* of the wheel 38, comprise no visible edge in the cylindrical portion 42. They cannot, therefore, be seen and the sought-after mysterious effect is achieved.

In the construction represented in the drawing, the cage of the tourbillion performs one revolution every two minutes. Naturally, the number of teeth can be adjusted such that the cycle of the tourbillion is different. It is worth pointing out, however, that the use of a cage wheel responsible for driving the cage increases its moment of inertia. It is hence preferable to have a relatively long rotation cycle to avoid overloading the movement.

Advantageously, this movement is disposed in a sheath defining an opening through which the tourbillion is visible and the circumference of which fits on the outer surface of the cylindrical portion such that the visible parts surrounding the tourbillion are masked.

Naturally, the movement such as described can form the subject of numerous variants, without, for all that, departing from the scope of the invention.

It is thus possible to use a floating tourbillion, that is to say one which pivots only on one of its sides. This solution is, nevertheless, only of minor interest, since the pivot means are virtually not visible. The cage wheel could form an integral part of the cage, the transparent platelet 38*a* being in this case constituted by a washer, the periphery of which forms the toothing 38*c* and on which are fixed bridges responsible for pivoting the escape mobile 34, the pallet fork 36 and the balance wheel 32.

It is thus possible to make the whole of the bottom plate and all of the bridges out of transparent material. Such a solution has the drawback, however, of reducing the mysterious effect.

Insofar as the plates 16 and 18 are made of sapphire, it is possible to realize the pivotings of the cage right there. It is also possible to add some stones in holes made for this purpose.

The transparent material may be natural or synthetic material. One example is corundum, which is aluminum oxide, or $Al_2O_3$. A particular species may be sapphire, also known as colorless sapphire. Other transparent, colorless materials include topaz or zircon. The transparent material which is used is advantageously sapphire. It is also possible, however, to use quartz, glass, or even plastics material.

It is equally possible to fix the fixed wheel 40 onto a supplementary transparent plate, likewise fixed to the casing, and more particularly to the bottom plate 10.

This plate would in this case be breached to allow the passage of the shaft of the cage 26.

While a preferred embodiment has been described, the invention is not limited to the preferred embodiment disclosed. Numerous variations and modifications may be made without departing from the spirit and scope of the invention, which is defined by the following claims.

The invention claimed is:

1. A timepiece movement comprising:

a casing, said casing comprising:

a mechanical energy source;

a work train driven by the energy source;

a fixed wheel mounted on the casing; and a tourbillion comprising a cage which comprises a balance wheel, an escape mobile having a pinion engaging with the fixed wheel, and a cage wheel rotationally joined to the cage, and provided on its periphery with a toothing engaging with the work train, wherein the casing is constituted, in its radial part occupied by the tourbillion, by upper and lower plates of transparent material so that the tourbillion can be seen either through its upper plate or lower plate, and wherein the cage wheel comprises a platelet formed of transparent material which extends radially beyond the other constituents of the tourbillion.

2. The timepiece movement according to claim 1, wherein the cage comprises two pivots, each pivot being disposed at opposite ends of the central part of the cage, and each plate receiving one of the two pivots.

3. The timepiece movement according to claim 1, wherein the toothing is comprised of the same material as the platelet.

4. The timepiece movement according to claim 1, wherein the toothing is comprised of a metal ring.

5. The timepiece movement according to claim 1, wherein the transparent material is synthetic corundum.

6. The timepiece movement according to claim 1, wherein the transparent material is sapphire.

7. A timepiece movement comprising:

a casing, said casing comprising:

a mechanical energy source;

a work train driven by the energy source;

a fixed wheel mounted on the casing; and a tourbillion comprising a cage which comprises a balance wheel, an escape mobile having a pinion engaging with the fixed wheel, and a cage wheel rotationally joined to the cage, and provided on its periphery with a toothing engaging with the work train, wherein the casing is constituted, in its radial part occupied by the tourbillion, by upper and lower plates of transparent material so that the tourbillion can be seen either through its upper plate or lower plate, and wherein the cage wheel comprises a platelet formed of transparent material which extends radially beyond the other constituents of the tourbillion, wherein the cage comprises two pivots, each pivot being disposed at opposite ends of the central part of the cage, and each plate receiving one of the two pivots, wherein the toothing is comprised of the same material as the platelet, and wherein the transparent material is synthetic corundum.

* * * * *